US008011533B2

(12) United States Patent
Reineccius et al.

(10) Patent No.: US 8,011,533 B2
(45) Date of Patent: Sep. 6, 2011

(54) FLUID-CONTAINING SYSTEM WITH INCLINED SLEEVE

(75) Inventors: Teresa A. Reineccius, St. Paul, MN (US); Gary L. Sotebeer, Savage, MN (US)

(73) Assignee: Target Brands, Inc., Minneapolis, MN (US)

( * ) Notice: Subject to any disclaimer, the term of this patent is extended or adjusted under 35 U.S.C. 154(b) by 423 days.

(21) Appl. No.: 12/178,006

(22) Filed: Jul. 23, 2008

(65) Prior Publication Data

US 2010/0018988 A1 Jan. 28, 2010

(51) Int. Cl.

| | |
|---|---|
| ***A47F 1/00*** | (2006.01) |
| ***B65D 83/00*** | (2006.01) |
| ***B65D 35/56*** | (2006.01) |

(52) U.S. Cl. ..... 221/96; 221/92; 221/102; 221/305; 221/306

(58) Field of Classification Search ..... 221/92, 221/96, 97, 102, 297, 281, 303, 305, 312 C
See application file for complete search history.

(56) References Cited

U.S. PATENT DOCUMENTS

| | | | | |
|---|---|---|---|---|
| 3,331,533 | A * | 7/1967 | Krugger | 221/96 |
| 3,349,960 | A * | 10/1967 | Ketler | 221/96 |
| 3,896,977 | A * | 7/1975 | Bergstrom | 222/353 |
| 4,541,526 | A | 9/1985 | Berg et al. | |
| D316,205 | S | 4/1991 | Conrad | |
| 5,050,775 | A | 9/1991 | Marquardt | |
| 5,085,346 | A | 2/1992 | Wright | |
| 5,186,359 | A * | 2/1993 | Brown et al. | 222/1 |
| 5,971,204 | A * | 10/1999 | Apps | 221/92 |
| 6,062,431 | A | 5/2000 | Geshay | |
| RE38,377 | E | 1/2004 | Geshay | |
| 6,910,798 | B2 | 6/2005 | Lloyd | |
| 6,971,545 | B2 * | 12/2005 | Martinez et al. | 221/199 |
| 7,377,420 | B2 * | 5/2008 | Gardner | 229/122.23 |
| 2001/0035426 | A1 * | 11/2001 | Chamorro | 221/96 |
| 2003/0006243 | A1 | 1/2003 | Looney | |
| 2003/0213813 | A1 * | 11/2003 | Cook et al. | 222/105 |
| 2006/0289558 | A1 * | 12/2006 | Parker | 221/97 |

* cited by examiner

*Primary Examiner* — Gene Crawford
*Assistant Examiner* — Kelvin Randall, Jr.
(74) *Attorney, Agent, or Firm* — Theodore M. Magee; Westman, Champlin & Kelly, P.A.

(57) ABSTRACT

A fluid-containing system includes an enclosure that houses a fluid that is contained in a bladder coupled to a spigot and houses a sleeve that is inclined relative to the bottom of the enclosure. The spigot protrudes through a spigot opening in the enclosure, while the sleeve contains dispensable items that can be fed through a dispensable item opening in the enclosure.

22 Claims, 18 Drawing Sheets

FLUID-CONTAINING SYSTEM WITH INCLINED SLEEVE

BACKGROUND

Oftentimes parents are tasked with providing a beverage and snack during or after an event in which their children and other children are participants. Sports activities, educational activities and parties are some example events.

Easily assembling together and serving a beverage and snack can be difficult. Bulk beverages are brought to an event in some sort of container. Cups for drinking the beverage need to be provided. In addition, a separate snack needs to be made or purchased that goes with the beverage. After the beverage and the snack have been consumed, the used cups and wrappers still need to be disposed.

The discussion above is merely provided for general background information and is not intended to be used as an aid in determining the scope of the claimed subject matter.

SUMMARY

A fluid-containing system includes an enclosure. The enclosure includes a first interior portion that houses a fluid-containing bladder and a second interior portion that houses a sleeve that is inclined relative to the bottom of the enclosure. A spigot is coupled to the fluid-containing bladder and protrudes through a spigot opening in the enclosure, while the sleeve contains dispensable items that can be fed through a dispensable item opening in the enclosure. The enclosure also includes a third interior portion that houses waste.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a receptacle or enclosure that houses a flexible fluid container and a sleeve for containing a dispensable item, such as cups or food snacks. The sleeve is positioned in the enclosure at an incline so that the cups or consumable can be fed out of an opening in the enclosure one at a time. The fluid container is accessible from the exterior of the enclosure through a spigot. The enclosure also houses a trash containing portion accessible through a trash opening. The trash containing portion accommodates waste, such as used cups or wrappers from the food.

In one example, the flexible fluid container can include a beverage and the sleeve can contain cups or food snacks. In another example, the flexible fluid container can include a liquid medicine and the sleeve can contain appropriately sized cups that can retain a dosage of the medicine. In yet another example, the flexible fluid container can contain a non-ingestive liquid, such as mouthwash, and the sleeve can contain items that go along with the non-ingestive liquid, such as cup for allowing use of the mouthwash.

Figure 1:
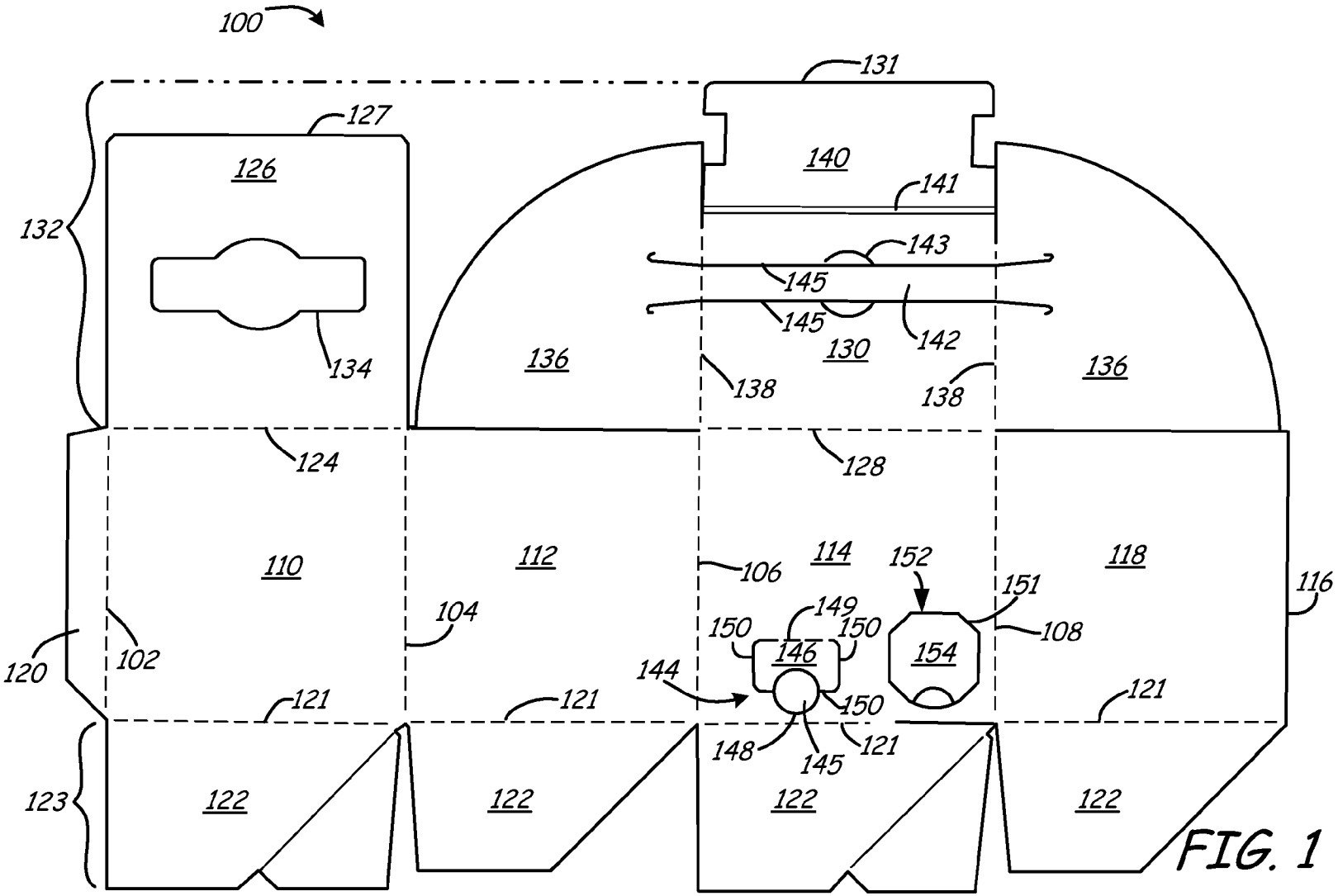
FIG. 1 illustrates a plan view of a sheet material formable into a receptacle or enclosure for containing a fluid under one embodiment.

FIG. 1 is a plan view of a sheet material 100 formable into a receptacle or enclosure 101 (FIGS. 3 and 5) for containing a fluid under one embodiment. Sheet material 100 includes a first score 102, a second score 104, a third score 106 and a fourth score 108. Second score 104 is spaced apart from and substantially parallel with first score 102 to define a back or back panel 110. Third score 106 is spaced apart from and substantially parallel with second score 104 to define a first side panel 112. Fourth score 108 is spaced apart from and substantially parallel with third score 106 to define a front panel 114. Sheet material 100 includes a side panel free edge 116. Side panel free edge 116 is spaced apart from and substantially parallel with fourth score 108 to define a second side panel 118.

Sheet material 100 also includes a glue flap 120. Glue flap 120 is coupled to back panel 110 at first score 102. Glue flap 120 is configured for receiving an adhesive so back panel 110 can be adhesively assembled into a position adjacent second side panel 118. In particular, side panel free edge 116 will come into alignment with first score 102 when glue flap 120 is adhesively attached to the interior of side panel 118. It should be realized that in the alternative, glue flap 120 can be coupled to a different one of panels 112, 114 and 118 depending on the particular layout of sheet material 100. For example, glue flap 120 can be coupled to second side panel 118 at side panel free edge 116, so second side panel 118 can be adhesively assembled into a position adjacent back panel 110.

Attached to a bottom score edge 121 of each of back panel 110, first side panel 112, front panel 114 and second side panel 118 includes bottom panels 122 for forming a bottom 123 of the receptacle or enclosure. Bottom panels 122 are for use in forming an auto bottom. However, it should be understood that other types of bottom panels can be utilized instead of panels 122 to form other types of bottoms. For example, bottom panels can be provided that form a tuck bottom, a sealed end bottom and a snap lock bottom.

Attached to a first top score edge 124 of back panel 110 is a first top panel 126 having a top free edge 127. Attached to a second top edge score 128 of front panel 114 is a second top panel 130 having a top free edge 131. First top panel 126 and second top panel 130 combine to form a top 132 of the receptacle or enclosure. First and second top panels 126 and 130 are for use in forming a sealed top end. However, it should be understood that other types of top panels can be utilized instead of panels 126 and 130 to form other types of tops. For example, other types of top panels can be attached to the back panel 110 and front panel 114 as well as first and second side panels 112 and 118 as long as a top 132 provides a handle and a strong enough connection to the handle for the weight of the contents inside the receptacle or enclosure to be carried.

First top panel 126 includes a first top panel opening 134. First top panel opening 134 is located between first top edge score 124 and top free edge 127. Second top panel 130 includes a pair of radial flaps 136. Each radial flap 136 is attached to each side edge score 138 of second top panel 130 between second top edge score 128 and top free edge 131. A distal portion 140 of second top panel 130 defined by a score edge 141 and top free edge 131 is folded over and secured over handle 142. Distal portion 140 is an optional feature for use in preventing pilferage of the receptacle or enclosure 101. In particular, distal portion 100 is folded over so that when handle 142 is lifted, distal portion 140 covers the hole that the handle created.

Handle 142 includes handle opening 143 and a pair of handle die cuts 145 that define handle 142. When forming the top 132 of the receptacle or enclosure, second top panel 130 in combination with radial flaps 136 are inserted down and in between side panels 112 and 118 and first top panel 126 is folded over second top panel 130. Opening 134 allows a user to access handle 142 for carrying the receptacle or enclosure. It should be understood that other ways of forming a handle in top panels 126 and 130 are possible. In another embodiment, a handle can be formed from a piece of resilient plastic and then tied to a top panel structure to make a handle strong enough to support the weight of the enclosure and its contents. In yet another embodiment, a handle can be reinforced with various forms of tape or adhesive.

Front panel 114 of sheet material 100 includes a spigot opening 144. Spigot opening 144 is formed upon the removal of a piece 145 of sheet material 100. The piece 145 is detachable from front panel 114 at its perforated edges. Spigot opening 144 is defined by spigot flap 146 and a bottom opening edge 148. Spigot flap 146 is attached to front panel 114 at score edge 149 and a plurality of perforated edges 150 that are detachable from front panel 114. Together spigot flap 146 and bottom opening edge 148 provide a stable structure for supporting a spigot.

Front panel 114 of sheet material 100 also includes a dispensable item opening 152. As illustrated in FIG. 1, dispensable item opening is formed by detaching a detachable piece 154 of sheet material 100. Dispensable item opening 152 is sized to feed dispensable items. For example, dispensable items can include clean cups or food snacks that dispense one at a time. Dispensable item opening 152 will be discussed in greater detail below.

Figure 2:
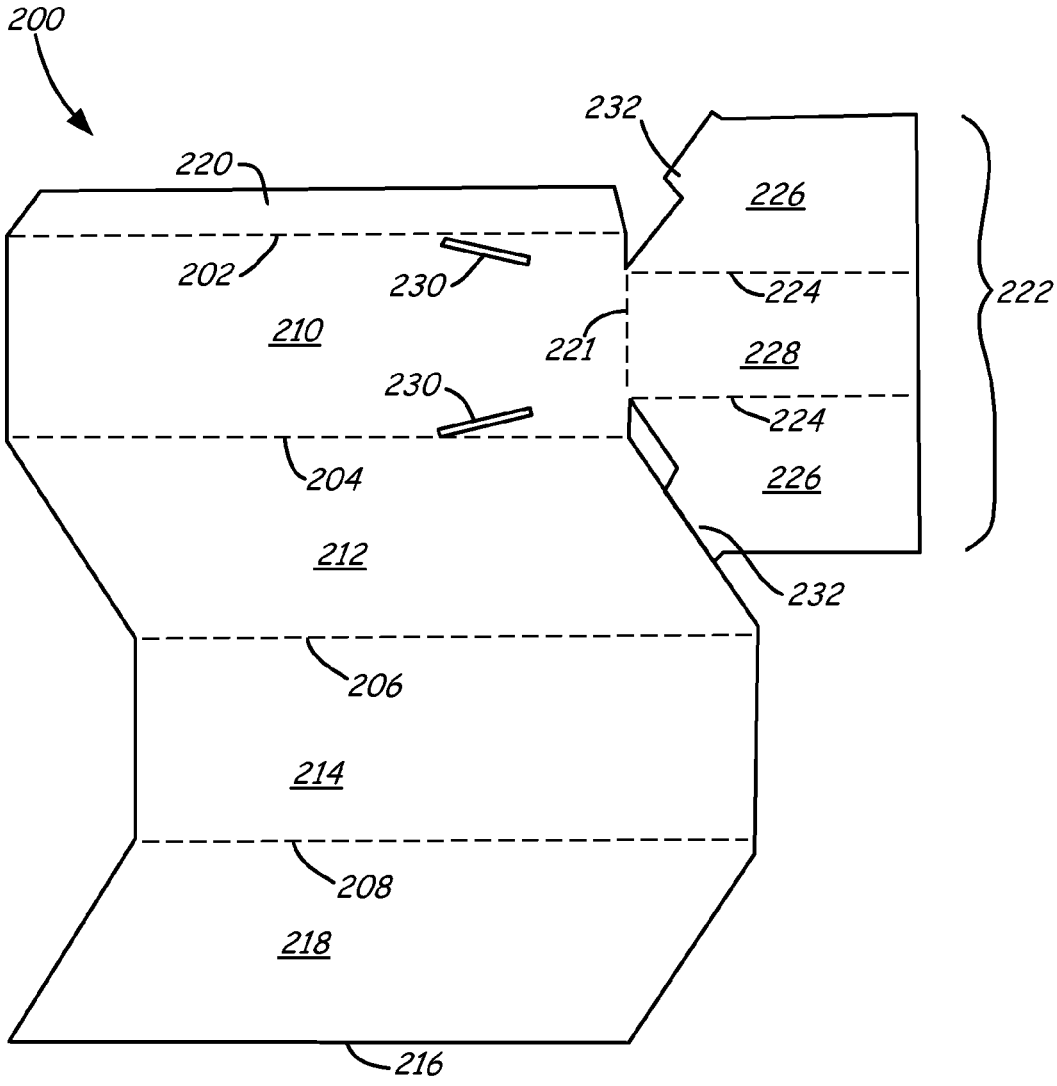
FIG. 2 illustrates a plan view of a sheet material formable into a sleeve to be contained in an enclosure under one embodiment

FIG. 2 is a plan view of a sheet material 200 formable into a sleeve 201 (FIGS. 4 and 5) for containing dispensable items under one embodiment. Sheet material 200 includes a first score 202, a second score 204, a third score 206 and a fourth score 208. Second score 204 is spaced apart from and substantially parallel with first score 202 to define a bottom or bottom panel 210. Third score 206 is spaced apart from and substantially parallel with second score 204 to define a first side panel 212. Fourth score 208 is spaced apart from and substantially parallel with third score 206 to define a top or top panel 214. Sheet material 100 includes a side panel free edge 216. Side panel free edge 216 is spaced apart from and substantially parallel with fourth score 208 to define a second side panel 218.

Sheet material 200 also includes a glue flap 220. Glue flap 220 is coupled to bottom panel 210 at first score 202. Glue flap 220 is configured to receive an adhesive so bottom panel 210 can be adhesively assembled into a position adjacent second side panel 218. In particular, side panel free edge 216 will come into alignment with first score 202 when glue flap 220 is adhesively attached to the interior of side panel 218. It should be realized that in the alternative, glue flap 220 can be coupled to a different one of panels 212, 214 and 218 depending on the particular layout of sheet material 200. For example, glue flap 220 can be coupled to second side panel 218 at side panel free edge 216, so second side panel 218 can be adhesively assembled into a position adjacent bottom panel 210.

Figure 4:
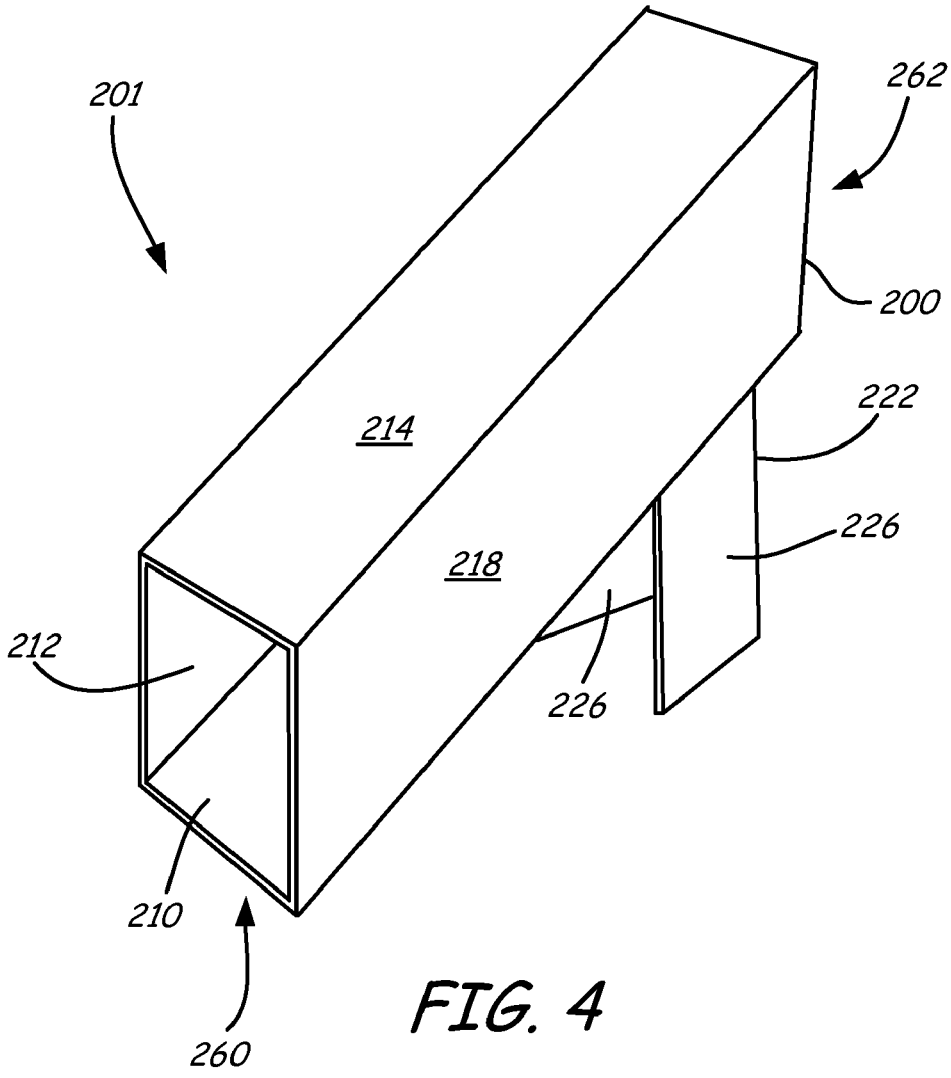
FIG. 4 illustrates a top perspective view of the sheet material of FIG. 2 formed into the sleeve in an assembled state.

Attached to a partially scored side edge 221 of bottom panel 210 is a support panel 222 for forming a support for sheet material 200 when the sheet material is assembled into a sleeve 201 (FIG. 4). Support panel 222 includes a pair of scores 224 that provide support panel with three portions. Exterior portions 226 fold along scores 224 to form middle portion 228.

Bottom panel 210 includes a pair of slots 230. Slots 230 are configured to mate with tabs 232 that are coupled to exterior portion 226 of support panel 222. As will be discussed in detail in regards to FIG. 4, support panel 222 is folded at the score of side edge 221 and folded at scores 224. These folds allow tabs 232 of support panel to insert in slots 230 to thereby create a support. It should be realized that sheet material 200 can include other types of configurations of support panels coupled to bottom, first side, top and second side panels 210, 212, 214 and 216 that can be assembled with sleeve 201 in other ways or be a separate piece from sleeve 201.

Figure 3:
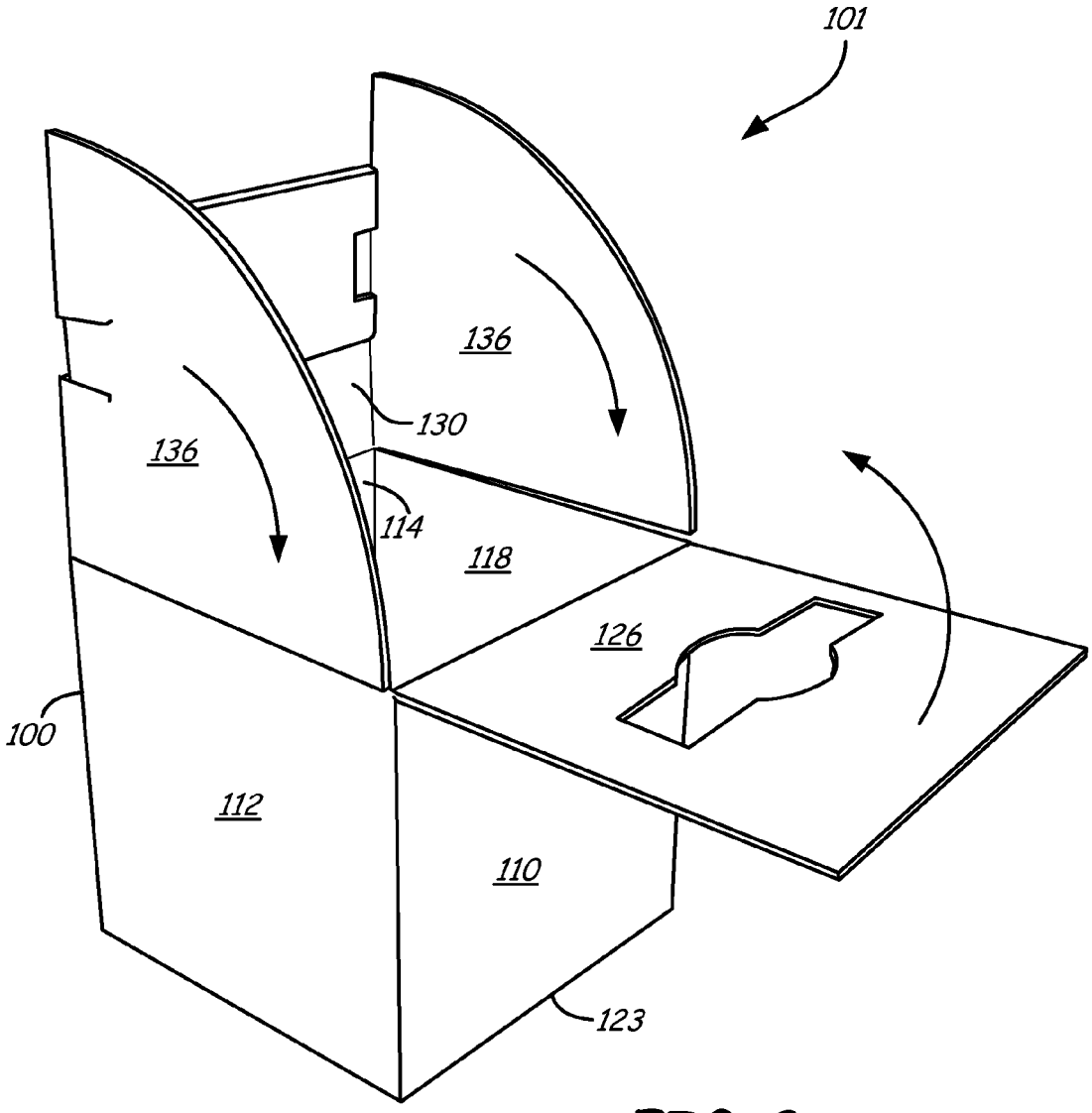
FIG. 3 illustrates a top perspective view of the sheet material of FIG. 1 formed into the receptacle or enclosure in a partially assembled state.

FIG. 3 illustrates a top perspective view of sheet material 100 (FIG. 1) partially formed into a receptacle or enclosure 101. FIG. 3 illustrates back panel 110, front panel 114, first side panel 112, second side panel 118 and bottom 123 assembled together. First top panel 126 and second top panel 130, with distal portion 140 folded over, are not yet in an assembled position. However, it can be seen that radial flaps 136 fold inwardly and will slide along each of the first side panel 112 and second side panel 118 when second top panel 130 forms top 132. After second top panel 130 is in position, first top panel 126 is folded over on top of second top panel 130. Since enclosure 101 is illustrated in FIG. 3 from a back view, spigot opening 144 and dispensable item opening 152 are not shown.

FIG. 4 illustrates a top perspective view of sheet material 200 (FIG. 2) formed into a sleeve 201 in an assembled state. FIG. 4 illustrates bottom panel 210, top panel 214, first side panel 212 and second side panel 218 assembled together to form a first end 260 and a second end 262. As illustrated, support panel 222 is folded downwardly from bottom panel 210 at second end 262 and exterior portions 226 are folded inwardly towards middle portion 228 (not shown in FIG. 4). Tabs 232 (not shown in FIG. 4), that are formed integrally with support panel 222, are tucked into slots 230 (not shown in FIG. 4) to form a support for panels 210, 212, 214 and 218. Support panel 222 allows sleeve 201 to be inclined from the first end 260 to second end 262.

Figure 5:
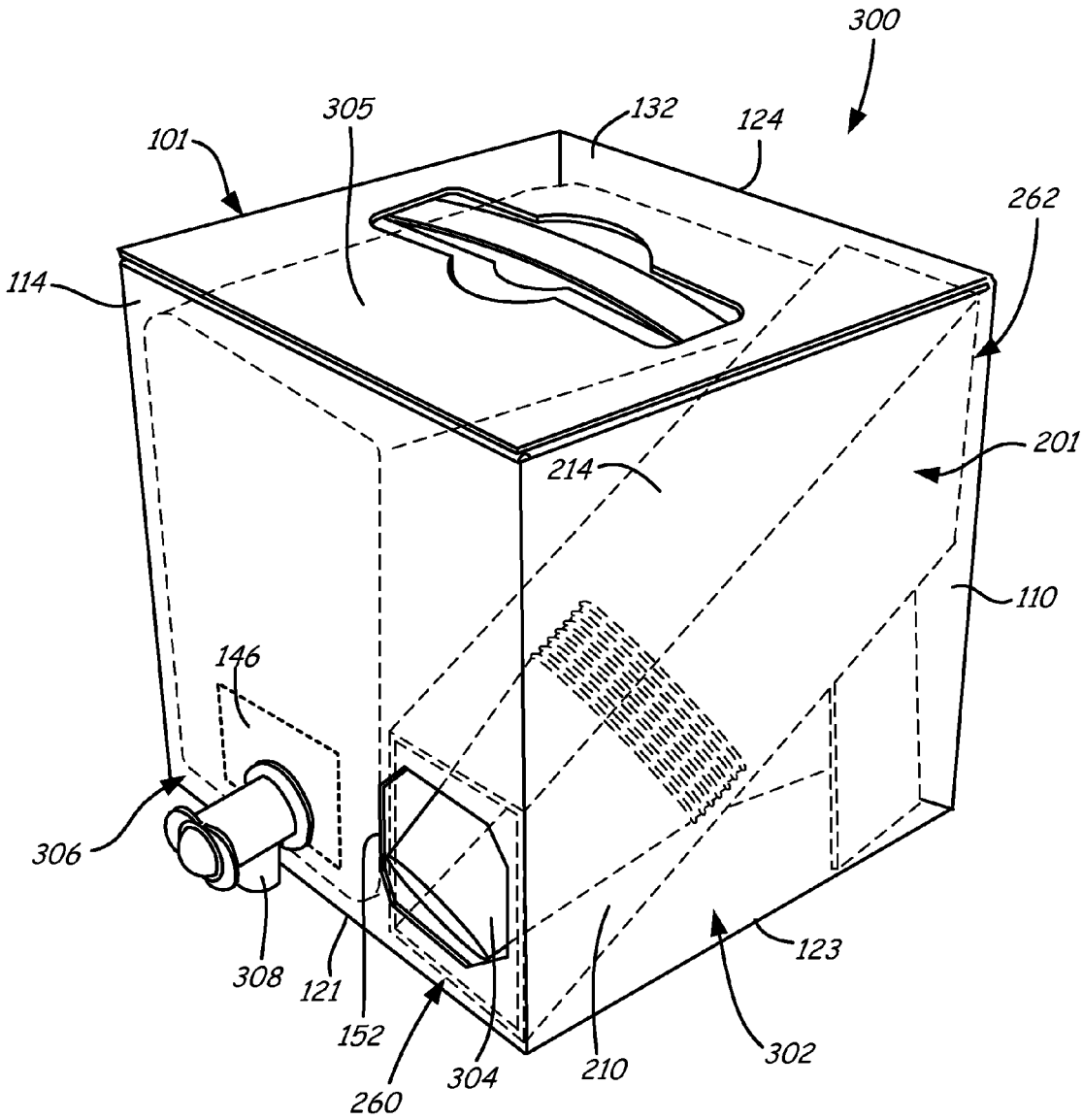
FIG. 5 illustrates a top perspective view of a package including the receptacle or enclosure of FIGS. 1 and 3 containing the sleeve of FIGS. 2 and 4 in a final formed state under one embodiment.

FIG. 5 illustrates a top perspective view of a package 300 including the enclosure 101 of FIGS. 1 and 3 containing the sleeve 201 of FIGS. 2 and 4 in a finally formed state under one embodiment. It should be realized that the enclosure and sleeve illustrated in FIG. 5 need not include features that are exactly like the features described in FIGS. 1 and 2. The enclosure and sleeve can include other types of features as long as these features provide an enclosure that can accommodate a sleeve for dispensing items and a fluid.

Sleeve 201 is housed in enclosure 101 in a sleeve portion 302 of package 300. As illustrated, first end 260 of sleeve 201 is proximate to front panel 114 of enclosure 101 and second end 262 of sleeve 201 is proximate to back panel 110 (not illustrated in FIG. 5) of enclosure 101. It should be realized, in the alternative, it is possible for first end to be proximate to back panel 110 and second end 262 to be proximate to front panel 114. First end 260 is inclined from second end 262 relative to bottom 123 of enclosure 101.

Figure 6:
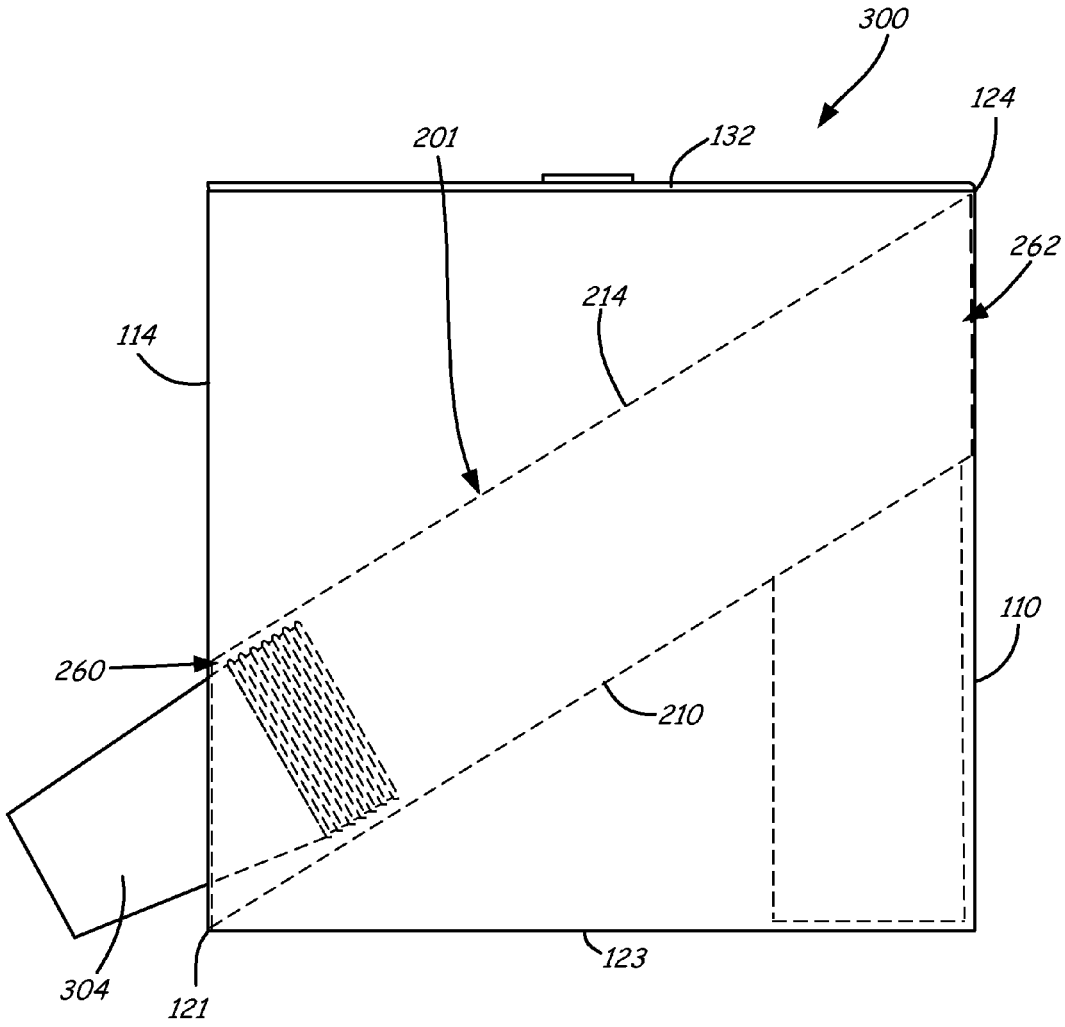
FIG. 6 illustrates a side view of the package illustrated in FIG. 5.

FIG. 6 illustrates a side view of package 300 of FIG. 5. In FIGS. 5 and 6, an edge of sleeve 201 formed by top panel 214 and second end 262 substantially abuts first top score edge 124 (see also FIG. 1). First top score edge 124 is the edge of enclosure 101 that couples top 132 to back panel 110. As also illustrated in the embodiment of FIGS. 5 and 6, an edge of sleeve 201 formed by bottom 123 and first end 260 substantially abuts bottom score edge 121 (see also FIG. 1). Bottom score edge 121 is the edge of enclosure 101 that couples one of the bottom panels 122 (FIG. 1) of enclosure 101 with front panel 114 of the enclosure.

Sleeve 201 houses dispensable items, such as a plurality of cups 304 as illustrated in FIGS. 5 and 6. The plurality of cups 304 are exposed to the exterior of enclosure 101 through dispensable item opening 152. As illustrated, dispensable item opening 152 has a smaller circumferential opening than that of the opening in first end 260 of sleeve 201. In addition, dispensable item opening 152 has a circumferential opening that is less than the circumference of the lip of a cup. Having a smaller sized dispensable item opening 152 than the opening in first end 260 and the circumference of a cup allows the plurality of cups to feed out of the sleeve 201 and dispensable item opening 152 one at a time from the inclined position. In another example, sleeve 201 can also house a plurality of food snacks that can feed out of dispensable item opening 152

Package 300 also includes a flexible fluid container or fluid-containing bladder 305 located in a fluid portion 306 of package 300. Coupled to the fluid container 305 is spigot 308. Spigot 308 allows access to the fluid contained in container 305. Spigot 308 is exposed to the exterior of enclosure 101 through a spigot opening (hidden from view in FIGS. 5 and 6) in front panel 114. Both spigot flap 146 and a bottom opening edge (hidden from view in FIGS. 5 and 6) are located in front panel 114 to support spigot 308 when it is exposed to the exterior of enclosure 101 as illustrated in FIG. 5. Therefore, a user can pull a cup from dispensable item opening 152 and fill the cup with the fluid in container 305 through spigot 308.

Figure 7:
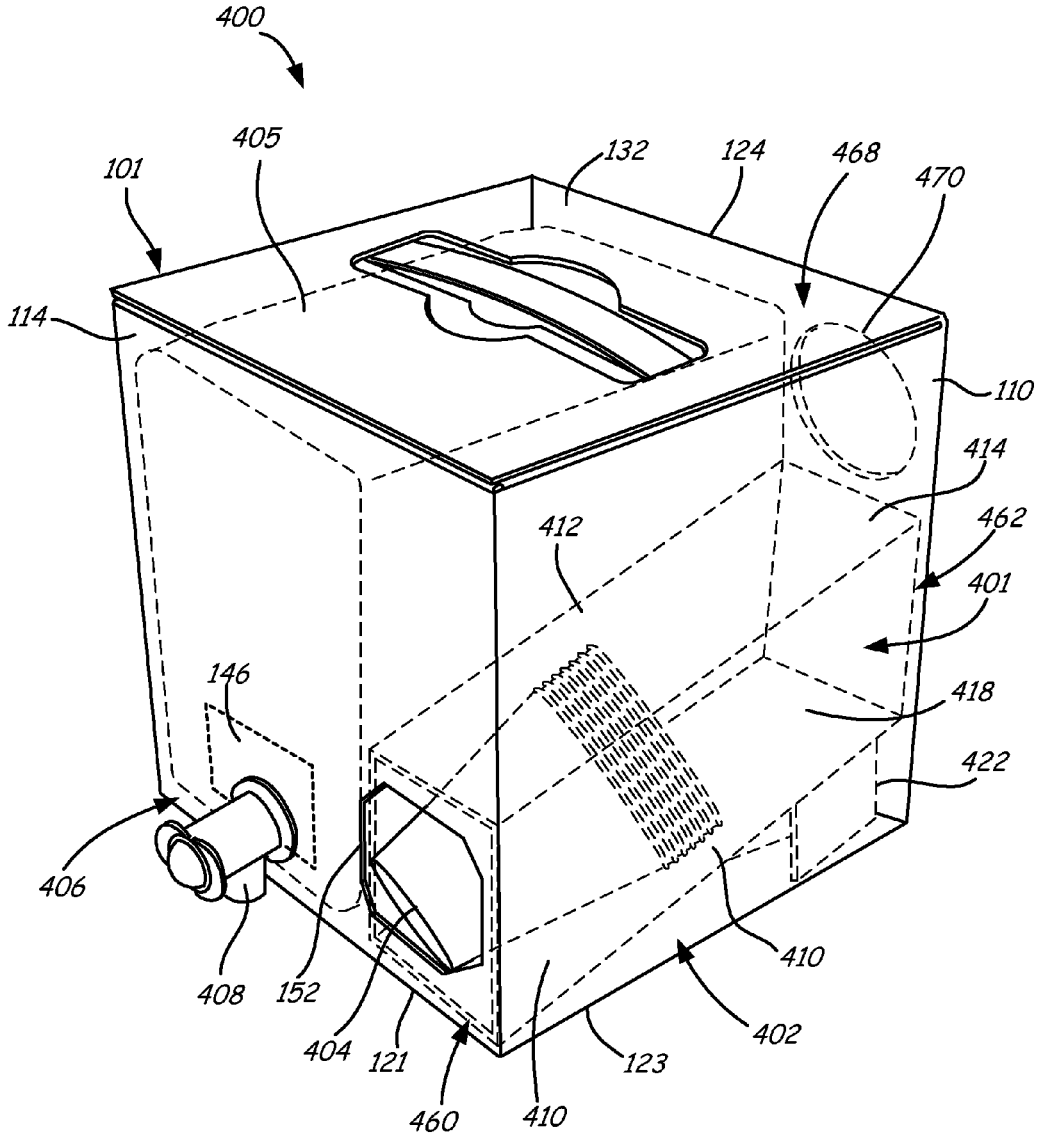
FIG. 7 illustrates a top perspective view of a package including the receptacle or enclosure of FIGS. 1 and 3 containing a sleeve in a final formed state under another embodiment.
Figure 8:
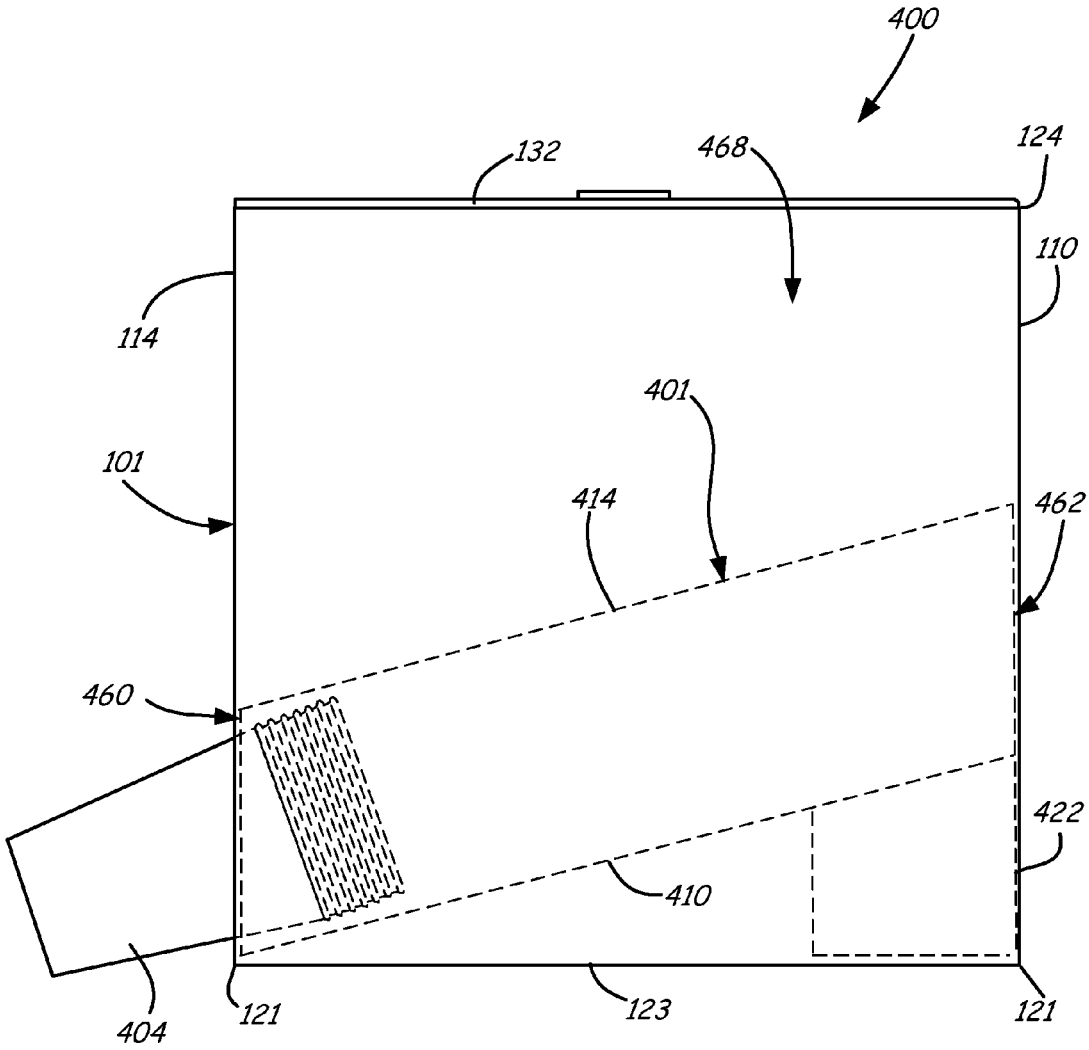
FIG. 8 illustrates a side view of the package illustrated in FIG. 7.

FIG. 7 illustrates a top perspective view of a package 400 including the enclosure 101 of FIGS. 1 and 3 containing a sleeve 401 in a finally formed state under another embodiment. FIG. 8 illustrates a side view of package 400. In FIGS. 7 and 8, enclosure 101 is illustrated as being the enclosure described in FIGS. 1 and 3. However, it should be realized that the enclosure illustrated in FIGS. 7 and 8 need not include features that are exactly like the features described in FIGS. 1 and 3. The enclosure can include other types of features as long as those features provide an enclosure that can accommodate a sleeve for dispensing dispensable items and a fluid.

Sleeve 401 includes a bottom panel 410, top panel 414, first side panel 412, second side panel 418 assembled together to form a first end 460 and a second end 462. As illustrated, sleeve 401 includes a support panel 422 for supporting bottom panel 410, top panel 414, first side panel 412 and second side panel 418. Support panel 422 can be similar to support panel 222 of FIGS. 2 and 4. Support panel 422 can be assembled with the sleeve 401 in other ways or be a separate piece from the sleeve. Regardless its specific features, support panel 422 allows sleeve 401 to be inclined from the first end 460 to second end 462.

Sleeve 401 is housed in enclosure 101 in a sleeve portion 402 of package 400. As illustrated, first end 460 of sleeve 401 is proximate to front panel 114 of enclosure 101 and second end 462 of sleeve 401 is proximate to back panel 110 of enclosure 101. It should be realized, in the alternative, it is possible for first end 460 to be proximate to back panel 110 and second end 462 to be proximate to front panel 114. Second end 462 is inclined from first end 460 relative to bottom 123 of enclosure 101.

As illustrated in FIGS. 7 and 8, second end 462 substantially abuts back panel 110 between first top score edge 124 (see also FIG. 1) and bottom score edge 121 that couples one of the bottom panels 122 (FIG. 1) with back panel 110. First end 460 substantially abuts an edge formed by bottom panel 410 (FIG. 2) and bottom score edge 121 (see also FIG. 1) that couples one of the bottom panels 122 (FIG. 1) with front panel 114. Therefore, the incline from first end 460 to second end 462 relative to bottom 123 is less steep than the incline illustrated in FIGS. 5 and 6.

Sleeve 401 houses dispensable items, such as a plurality of cups 404. The plurality of cups 404 are exposed to the exterior of enclosure 101 through dispensable item opening 152. As illustrated, dispensable item opening 152 has a smaller circumferential opening than that of the opening in first end 460 of sleeve 401. In addition, dispensable item opening 152 has a circumferential opening that is less than the circumference of the lip of a cup. Having a smaller sized dispensable item opening 152 than the opening in first end 460 and the circumference of a cup allows the plurality of cups 404 to feed out of the sleeve and dispensable item opening 152 one at a time from the inclined position. In another example, sleeve 401 can also house a plurality of food snacks that can feed out of dispensable item opening 152.

Package 400 also includes a flexible fluid container or fluid-containing bladder 405 located in a fluid portion 406 of package 400. Coupled to the fluid container 405 is a spigot 408. Spigot 408 allows access to the fluid contained in container 405. Spigot 408 is exposed to the exterior of enclosure 101 through a spigot opening (hidden from view in FIG. 7) in front panel 114. Both spigot flap 146 and a bottom opening edge (not illustrated in FIG. 7) in front panel 114 support spigot 408 when it is exposed to the exterior of enclosure 101.

Therefore, a user can pull a cup from dispensable item opening 152 and fill the cup with the fluid in container 405 through spigot 408.

By forming sleeve 401 at a less steep incline than that of sleeve 201 illustrated in FIGS. 5 and 6, package 400 can also include a trash containing portion 468 of the enclosure 101. The decrease in incline shown in FIGS. 7 and 8 compared to the sleeve shown in FIGS. 5 and 6 allows room for trash to be disposed of in enclosure 101. As illustrated, enclosure 101 of package 400 includes a trash opening 470. Trash opening 470 is formed upon the removal of a piece (not illustrated) of sheet material 100. In FIG. 7, the piece is detachable from back panel 110 at its perforated edges and positioned above second end 462 of sleeve 401. After a user has pulled a cup from dispensable item opening 152 and has filled the cup with the fluid through spigot 408, the user can drink the fluid and then discard the cup through trash opening 470.

Figure 9:
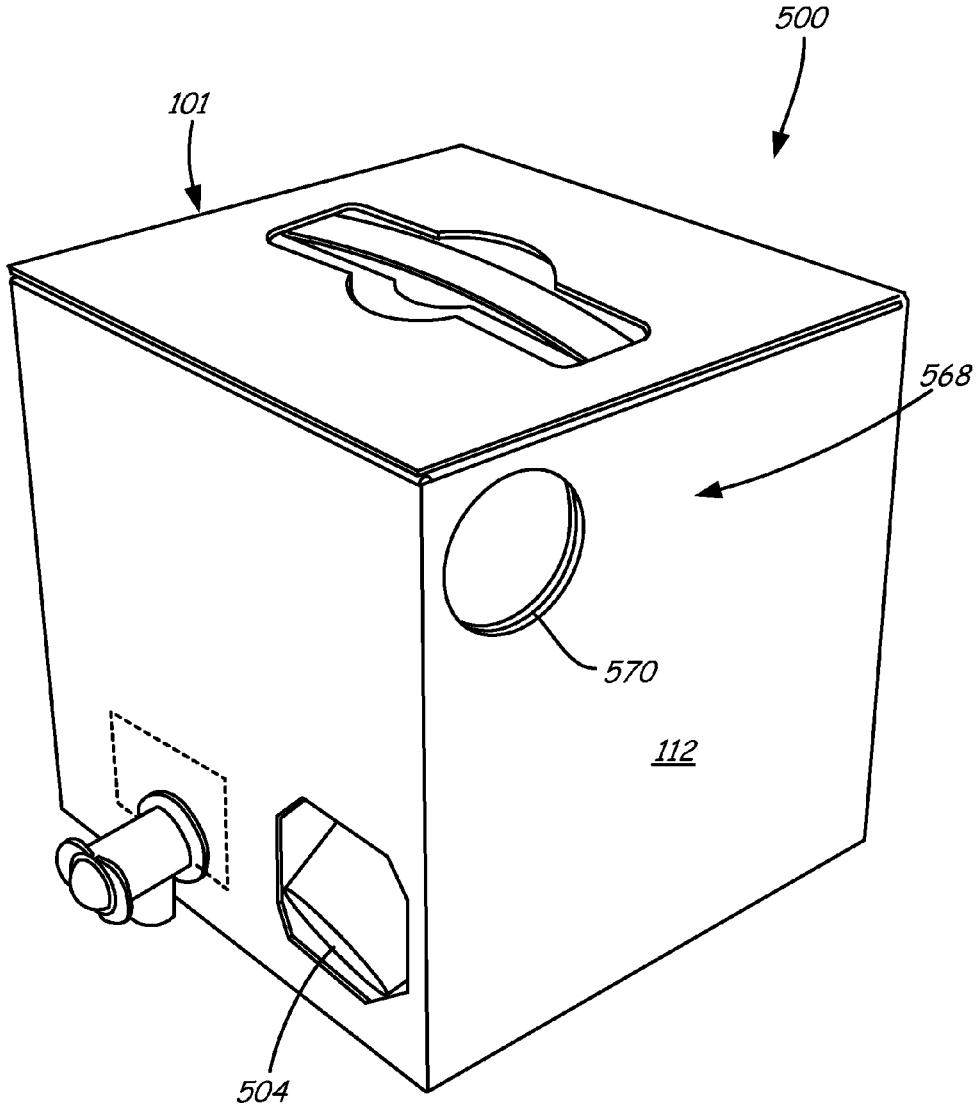
FIG. 9 illustrates a top perspective view of an alternative embodiment of the package illustrated in FIGS. 7 and 8.

It should be realized that trash opening 470 can be placed through other portions of enclosure 101 than just through back panel 110 above second end 462 of sleeve 401. For example, FIG. 9 illustrates a top perspective view of a package 500 with a trash opening 570 located in a different position. As illustrated in FIG. 9, trash opening 570 is positioned through side panel 112 of enclosure 101 along a trash containing portion 568 that is located above a sleeve containing a plurality of cups 504. It should be realized that trash opening 570 can be located in other positions on side panel 112 to discard waste into a trash containing portion 568 that is below a sleeve containing the plurality of cups 504.

Figure 10:
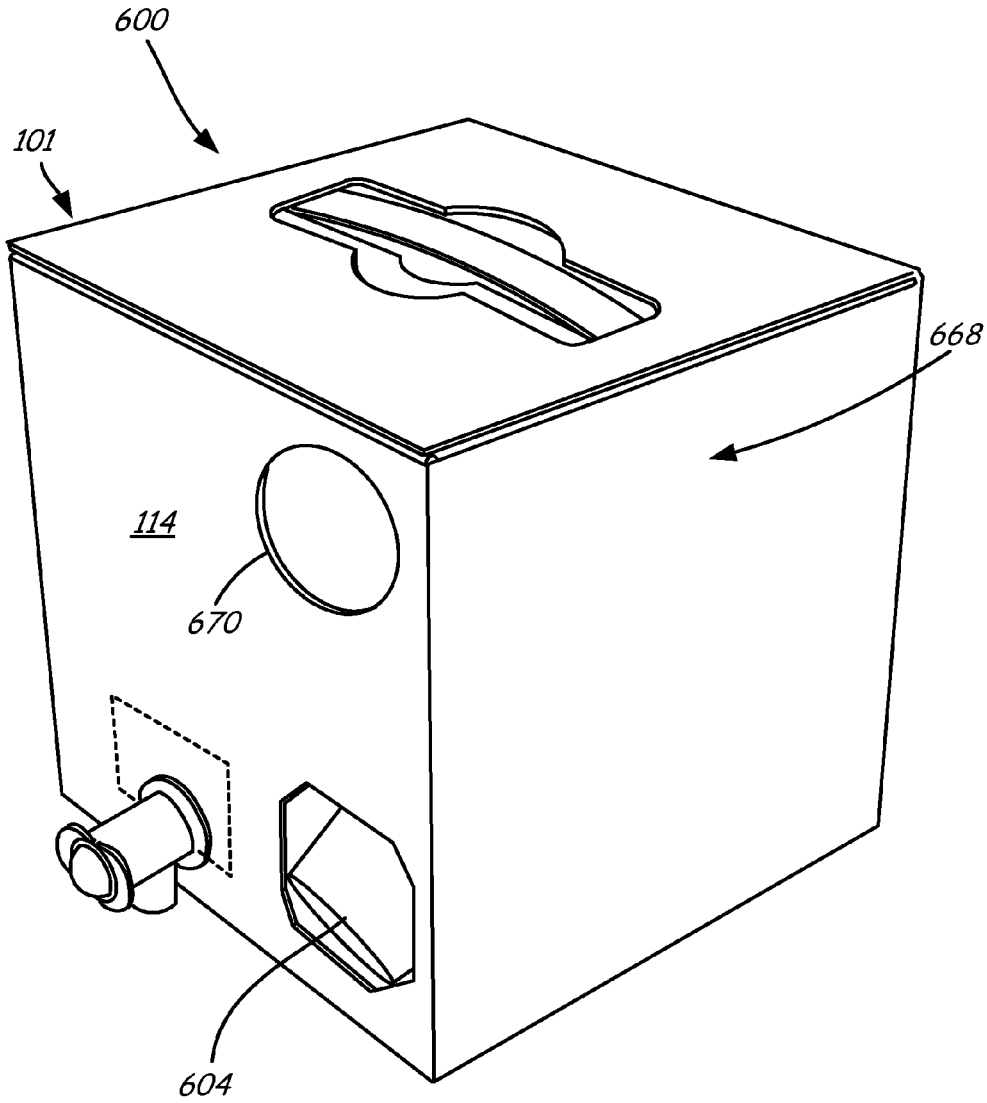
FIG. 10 illustrates a top perspective view of an alternative embodiment of the package illustrated in FIGS. 7 and 8.
Figure 11:
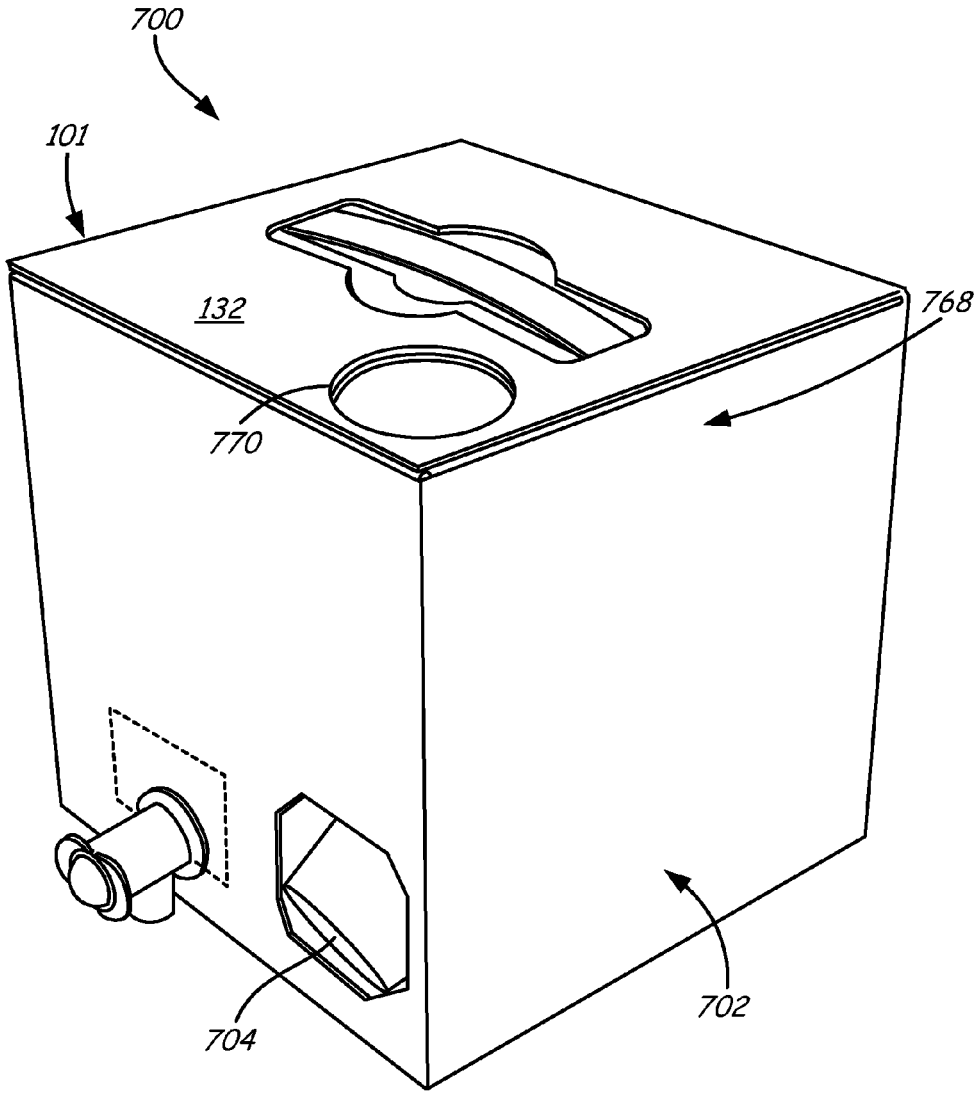
FIG. 11 illustrates a top perspective view of an alternative embodiment of the package illustrated in FIGS. 7 and 8.

In another example, FIG. 10 illustrates a top perspective view of a package 600 with a trash opening 670 located in a different position. As illustrated in FIG. 10, trash opening 670 is positioned through front panel 114 of enclosure 101 along a trash containing portion 668 that is located above a sleeve containing a plurality of cups 604. In yet another example, FIG. 11 illustrates a perspective view of a package 700 with a trash opening 770 located in a different position. As illustrated in FIG. 11, trash opening 770 is positioned through top 132 of enclosure 101 along a trash containing portion 768 that is located above a sleeve containing a plurality of cups 704.

Figure 12:
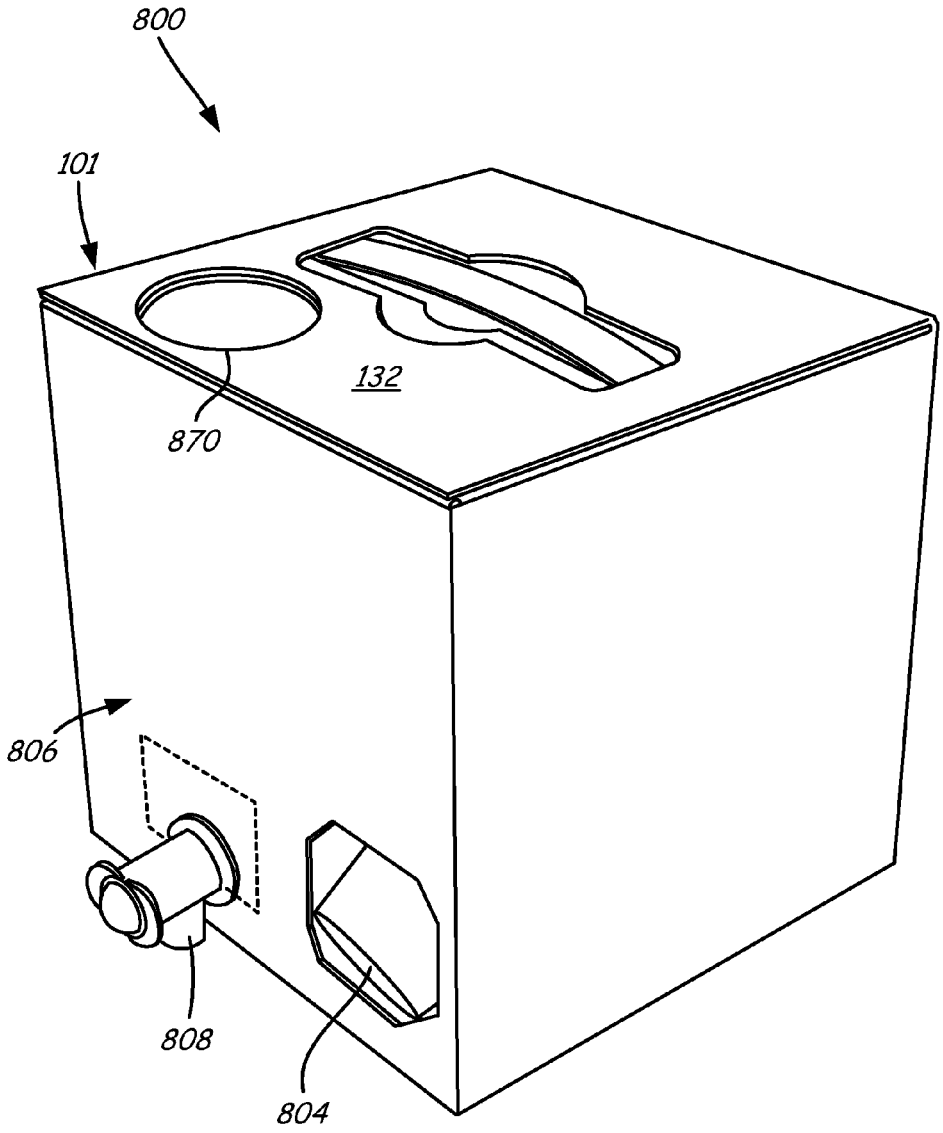
FIG. 12 illustrates a top perspective view of a package in yet another embodiment.

In still another embodiment, FIG. 12 illustrates a top perspective view of a package 800 with a trash opening 870 located in a different position. As illustrated in FIG. 12, trash opening 870 is positioned through top 132 of enclosure 101 like the embodiment illustrated in FIG. 11. However, trash opening 870 is located above fluid portion 806 of enclosure 101. In this embodiment, cups 804 can be discarded through trash opening 870 to take up the space between a flexible fluid container and top 132. As fluid is drained through spigot 808, the amount of space that flexible fluid container takes up becomes smaller thereby making space available that can accommodate trash.

Figure 13:
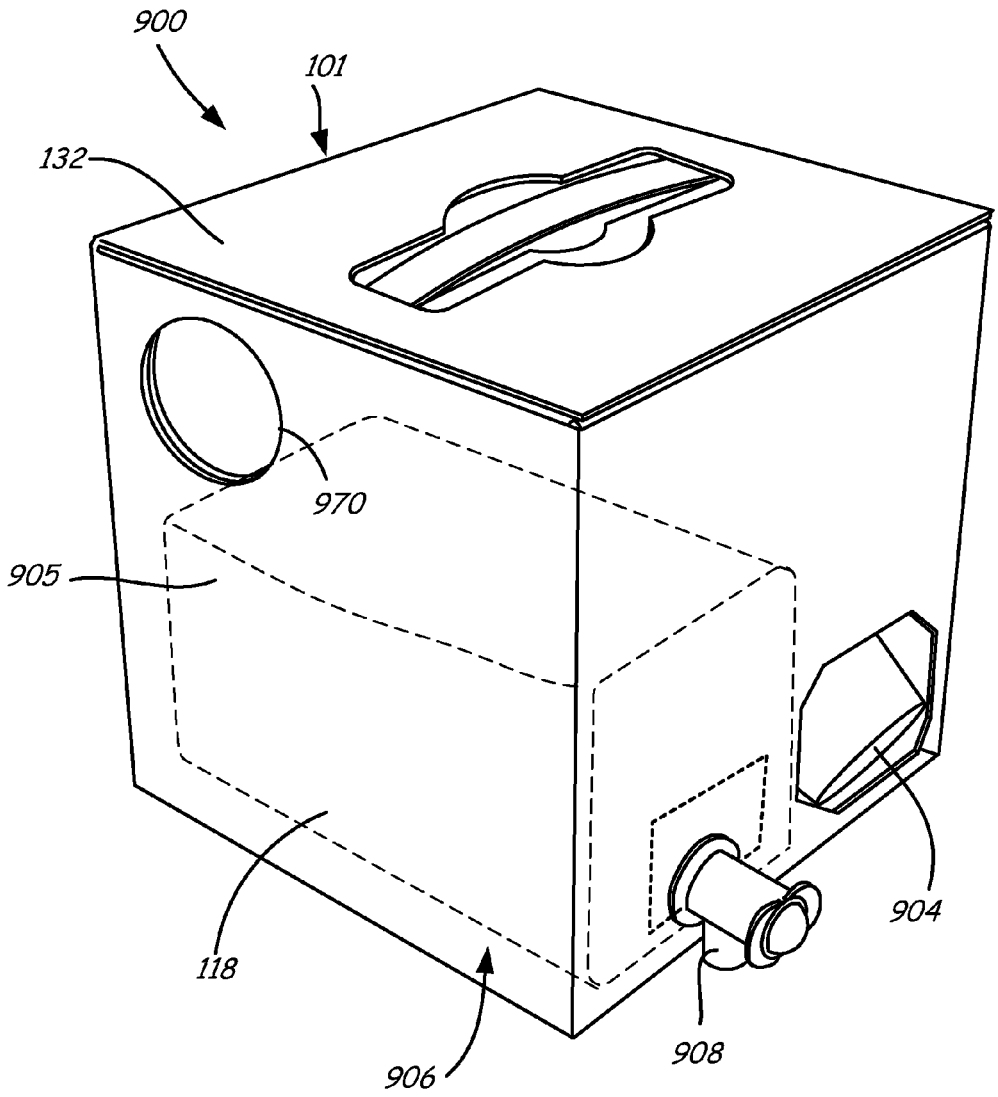
FIG. 13 illustrates a top perspective view of an alternative embodiment of the package illustrated in FIG. 12.

A trash opening can be positioned in other locations through enclosure 101 to discard trash in the space between the flexible fluid container and the top 132. For example, FIG. 13 illustrates a top perspective view of a package 900 with a trash opening 970 located in a different position. As illustrated in FIG. 13, trash opening 970 is positioned through side panel 118 of enclosure 101 above fluid portion 906. In this embodiment, cups 904 can be discarded through trash opening 970 within the space between a flexible fluid container 905 and top 132. As previously discussed, as fluid is drained through spigot 908, the amount of space that flexible fluid container 905 takes up becomes smaller thereby creating a space that can accommodate trash.

Figure 14:
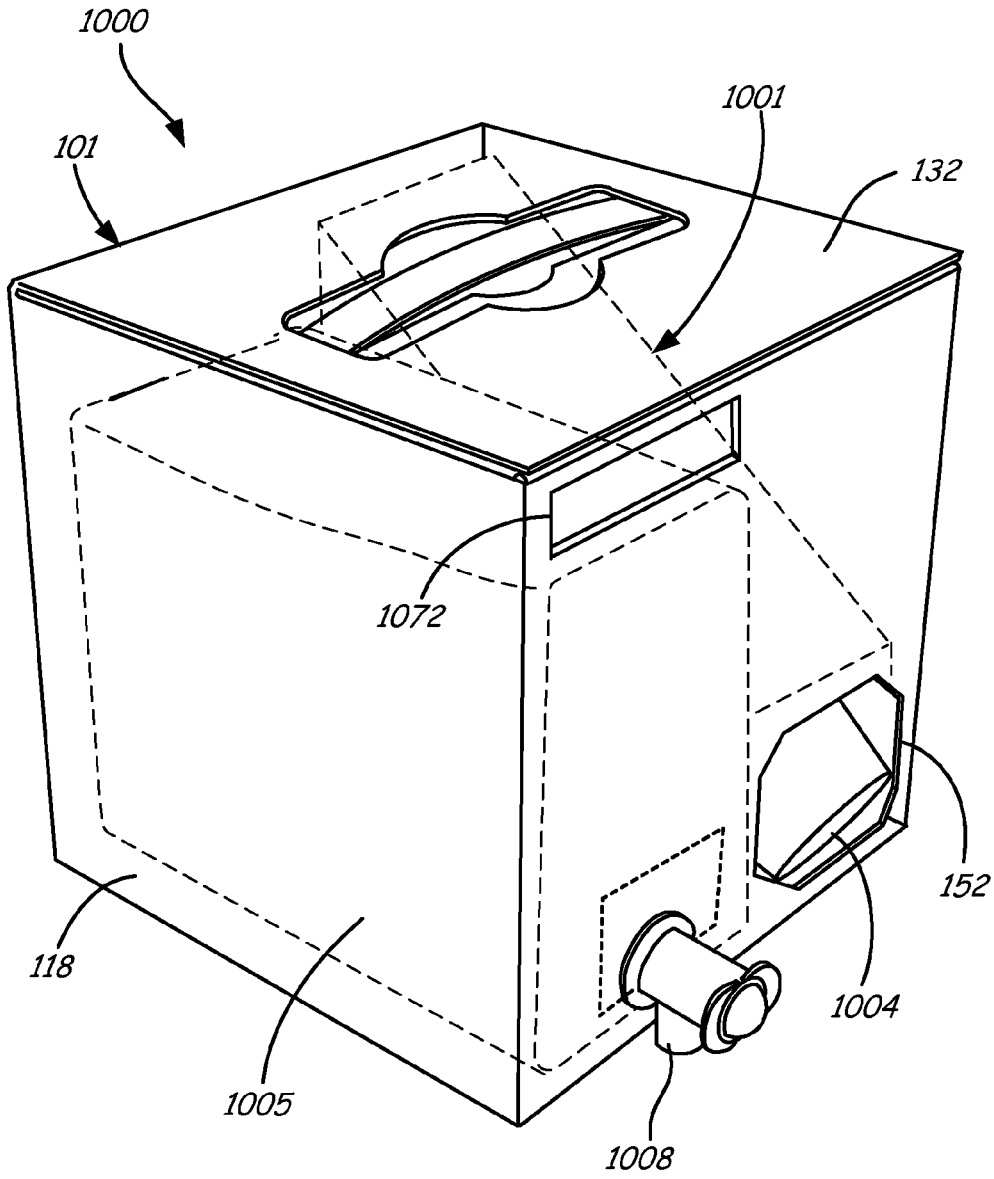
FIG. 14 illustrates a top perspective view of a package in yet another embodiment.
Figure 15:
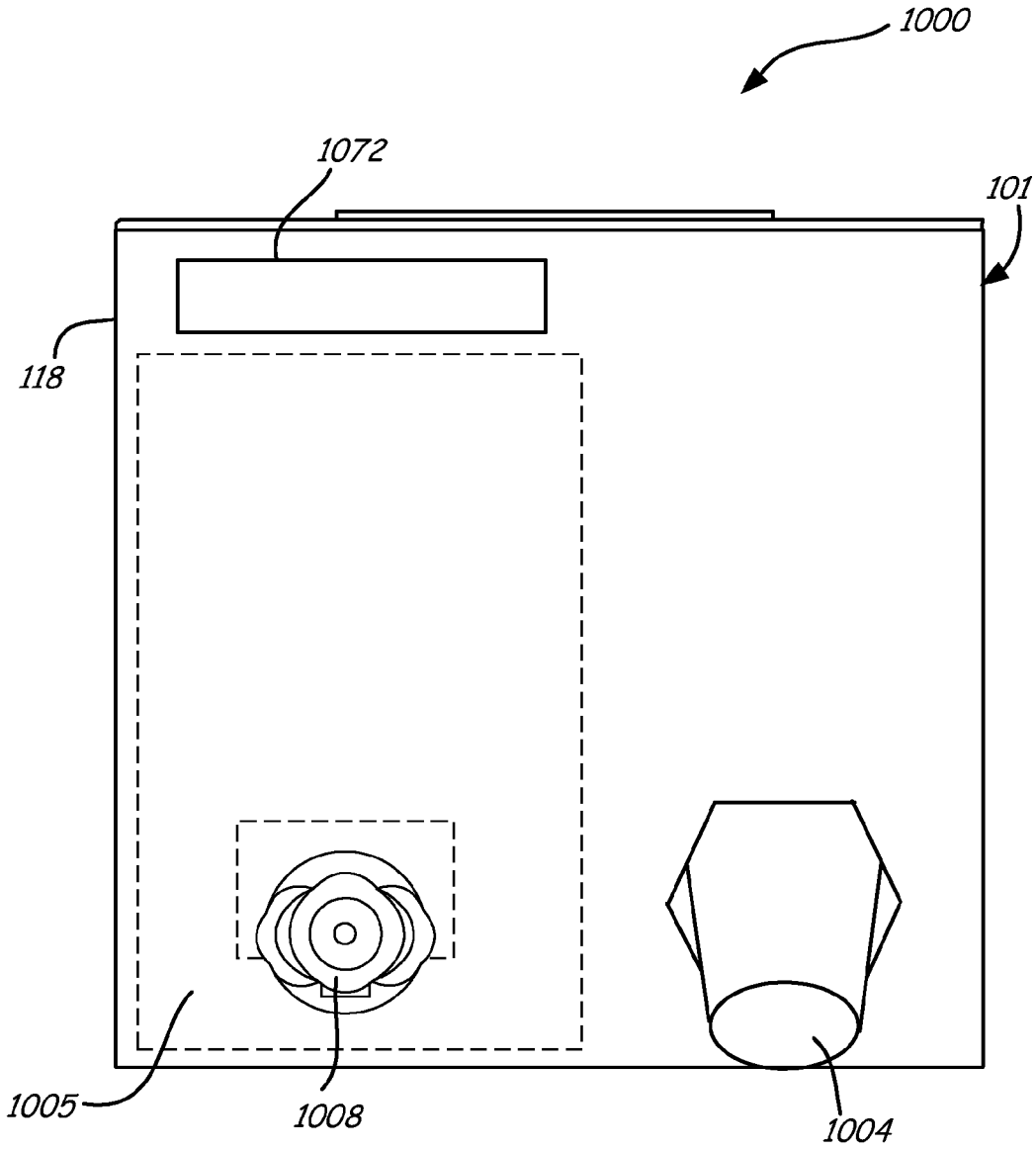
FIG. 15 illustrates a front view of the package illustrated in FIG. 14.

FIG. 14 illustrates a top perspective view of a package 1000 including the enclosure 101 of FIGS. 1 and 3 containing a sleeve 1001 in a finally formed state under another embodiment. FIG. 15 illustrates a front view of package 1000. In FIGS. 14 and 15, enclosure 101 is illustrated as being the enclosure 101 described in FIGS. 1 and 3. However, it should be realized that the enclosure illustrated in FIGS. 14 and 15 need not include features that are exactly like the features described in FIGS. 1 and 3. The enclosure can include other types of features as long as those features provide an enclosure that can accommodate a sleeve for dispensable items and a fluid.

Besides enclosure 101 of package 1000 including a dispensable item opening 152 for dispensing a plurality of cups 1004, enclosure 101 of package 1000 includes a slot 1072 positioned through front panel 114. Slot 1072 is formed upon the removal of a piece (not illustrated) of sheet material 100 (FIG. 1). In FIGS. 14 and 15, the piece is detachable from front panel 114 at its perforated edges and positioned above container 1005. Slot 1072 is configured to allow an ice package to be placed through front panel 114 on top of flexible fluid container 1005 to keep its contents cooled. It should be realized that slot 1072 can be positioned through other panels of enclosure 101. For example, slot 1072 can be positioned through side panel 118, top 132 and back panel 110.

Coupled to the fluid container 1005 is a spigot 1008. Spigot 1008 allows access to the fluid contained in container 1005. Spigot 1008 is exposed to the exterior of enclosure 101 through a spigot opening (hidden from view in FIGS. 14 and 15). Therefore, a user can pull a cup through dispensable item opening 152 and fill the cup with the fluid in container 1005 through spigot 1008, where the fluid is cooled by an ice package that is placed on top of fluid container 1005 through slot 1072.

Figure 16:
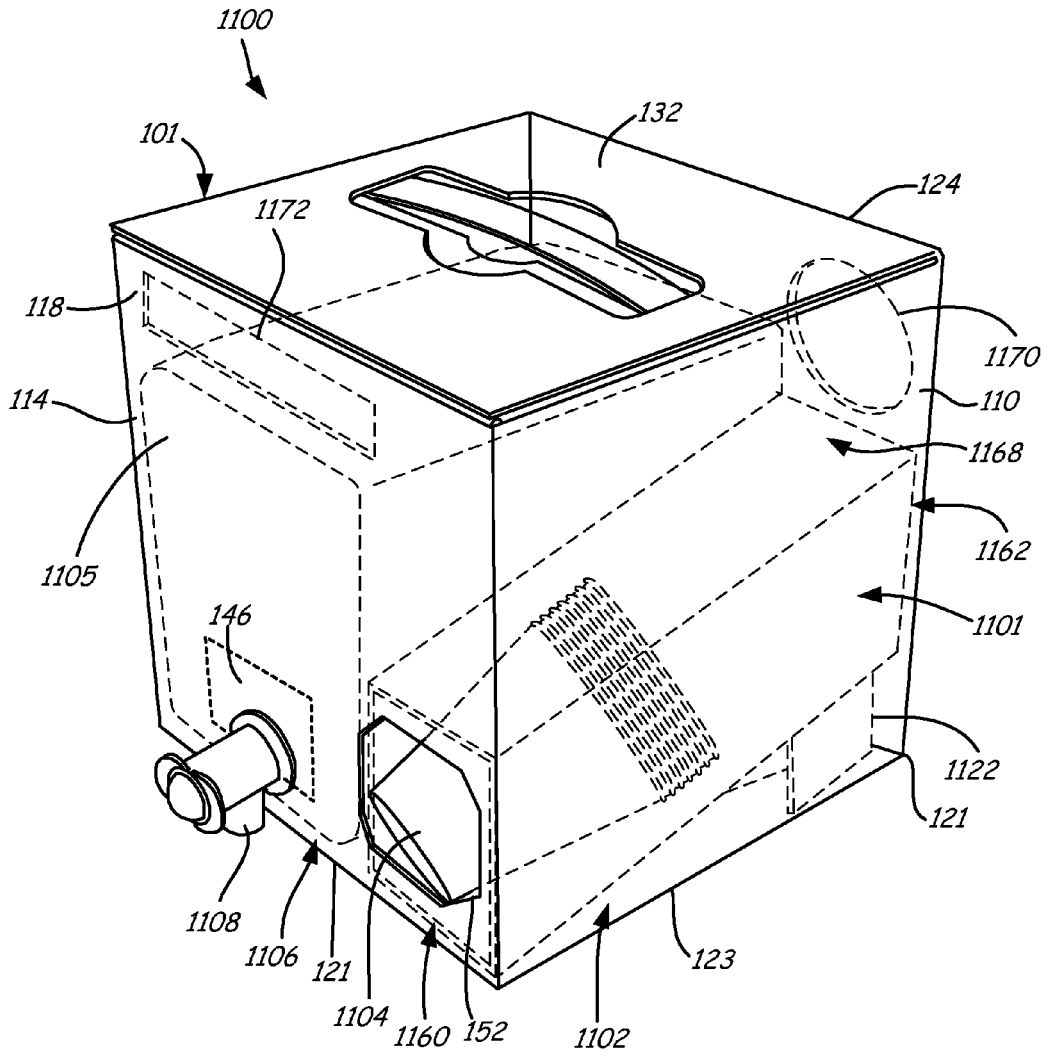
FIG. 16 illustrates a top perspective view of a package including the receptacle or enclosure of FIGS. 1 and 3 containing the sleeve of FIGS. 7 and 8 in a final formed state under one embodiment.

FIG. 16 illustrates a top perspective view of a package 1100 including the enclosure 101 of FIGS. 1 and 3 containing a sleeve 1101 in a finally formed state under another embodiment. In FIG. 16, enclosure 101 is illustrated as being the enclosure described in FIGS. 1 and 3. However, it should be realized that the enclosure illustrated in FIG. 16 need not include features that are exactly like the features described in FIGS. 1 and 3. The enclosure can include other types of features as long as those features provide an enclosure that can accommodate a sleeve for dispensable items and a fluid.

Package 1100 in FIG. 16 illustrates a combination of features discussed in FIGS. 7-8 and 14-15. Package 1100 includes a sleeve 1101 that includes a first end 1160 and a second end 1162. As illustrated, sleeve 1101 is supported by a support panel 1122. Support panel 1122 can be similar to support panel 222 of FIGS. 2 and 4. Support panel 1122 can be assembled with the sleeve portion of sleeve 1101 in other ways or be a separate piece from the sleeve portion. Regardless of its specific features, support panel 1122 allows sleeve 1101 to be inclined from the first end 1160 to second end 1162.

Sleeve 1101 is housed in enclosure 101 in a sleeve portion 1102 of package 1100. As illustrated, first end 1160 of sleeve 1101 is proximate to front panel 114 of enclosure 101 and second end 1162 of sleeve 1101 is proximate to back panel 110) of enclosure 101. It should be realized, in the alternative, it is possible for first end 1160 to be proximate to back panel 110 and second end 1162 to be proximate to front panel 114. Second end 1162 is inclined from first end 1160 relative to bottom 123 of enclosure 101.

As illustrated in FIG. 16, second end 1162 substantially abuts back panel 110 between first top score edge 124 (see also FIG. 1) and bottom score edge 121 that couples the bottom 123 of enclosure 101 with the back panel. First end 1160 substantially abuts bottom score edge 121 (see also FIG.

1) that couples one of the bottom panels 122 (FIG. 1) with front panel 114. Therefore, the incline from first end 1160 to second end 1162 relative to bottom 123 is less steep than the incline illustrated in FIGS. 5 and 6.

Sleeve 1101 houses dispensable items, such as a plurality of cups 1104. The plurality of cups 1404 are exposed to the exterior of enclosure 101 through dispensable item opening 152. As illustrated, dispensable item opening 152 has a smaller circumferential opening than that of the opening in first end 1160 of sleeve 1101. In addition, dispensable item opening 152 has a circumferential opening that is less than the circumference of the lip of a cup. Having a smaller sized dispensable item opening 152 than the opening in first end 1160 and the circumference of a cup allows the plurality of cups to feed out of the sleeve and dispensable item opening one at a time from the inclined position. In another example, sleeve 1101 can house a plurality of food snacks.

Package 1100 also includes a flexible fluid container or fluid-containing bladder 1105 located in a fluid portion 1106 of package 1100. Coupled to the fluid container 1105 is a spigot 1108. Spigot 1108 allows access to the fluid contained in container 1105. Spigot 1108 is exposed to the exterior of enclosure 101 through a spigot opening (hidden from view in FIG. 16) located in front panel 114. A flap 146 in combination with a bottom open edge (hidden from view in FIG. 16) support spigot 1108 when it is exposed to the exterior of enclosure 101. Therefore, a user can pull a cup from dispensable item opening 152 and fill the cup with the fluid in container 1105 through spigot 1108.

By forming sleeve 1101 at a less steep incline than that of sleeve 201 illustrated in FIGS. 5 and 6, package 1100 can also include a trash containing portion 1168 of the enclosure 101. The decrease in incline allows room for trash to be disposed of in enclosure 101. As illustrated, enclosure 101 of package 1100 includes a trash opening 1170. In FIG. 7, trash opening 1170 is positioned through back panel 110 above second end 1162 of sleeve 1101. After a user has pulled a cup from sleeve 1101 through dispensable item opening 152 and has filled the cup with the fluid through spigot 1108, the user can drink the fluid and then discard the cup through trash opening 1170. As discussed above, trash opening 1170 can be positioned through enclosure 101 in a variety of different locations and is formed by removing a piece of sheet material 100 at its perforated edges.

Enclosure 101 of package 1100 includes a slot 1172 configured to allow an ice package to be inserted through front panel 114 and rest on top of flexible fluid container 1105 to keep its contents cooled. Slot 1172 is formed by removing a piece of sheet material 100 at its perforated edges. Of course, slot 1172 can be formed in other panels and positions in package 1100.

Figure 17:
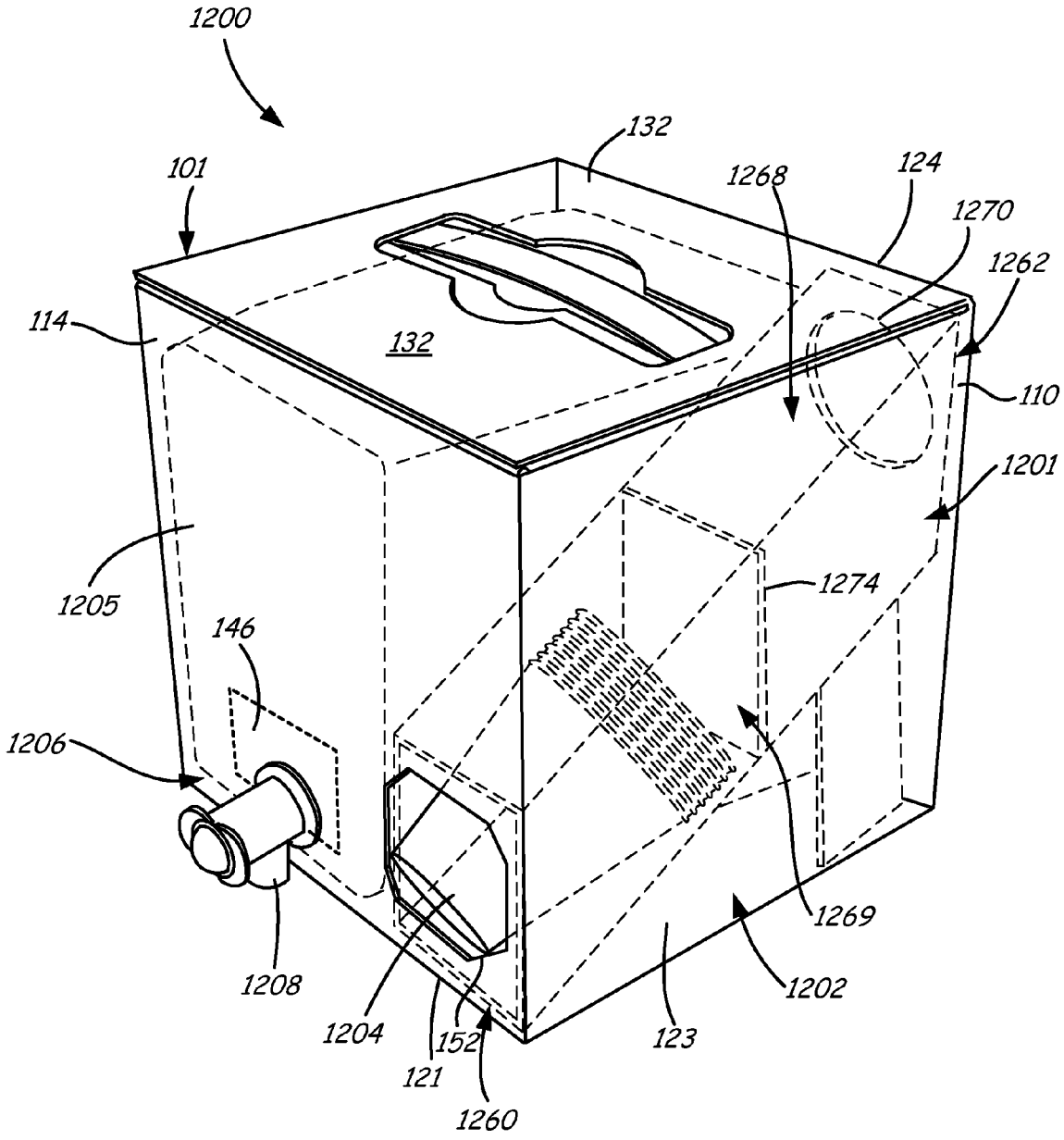
FIG. 17 illustrates a top perspective view of a package including the receptacle or enclosure of FIGS. 1 and 3 containing the sleeve of FIGS. 5 and 6 in a final formed state under one embodiment.

FIG. 17 illustrates a top perspective view of a package 1200 including the enclosure 101 of FIGS. 1 and 3 containing a sleeve 1201 in a finally formed state under yet another embodiment. It should be realized that the enclosure illustrated in FIG. 17 need not include features that are exactly like the features described in FIGS. 1 and 3. The enclosure can include other types of features as long as these features provide an enclosure that can accommodate a sleeve for dispensable items and a fluid.

Sleeve 1201 is housed in enclosure 101 in a sleeve portion 1202 of package 1200. As illustrated, first end 1260 of sleeve 1201 is proximate to front panel 114 of enclosure 101 and second end 1262 of sleeve 1201 is proximate to back panel 110 of enclosure 101. It should be realized, in the alternative, it is possible for first end to be proximate to back panel 110 and second end 1262 to be proximate to front panel 114. Second end 1262 is inclined from first end 1260 relative to bottom 123 of enclosure 101.

Figure 18:
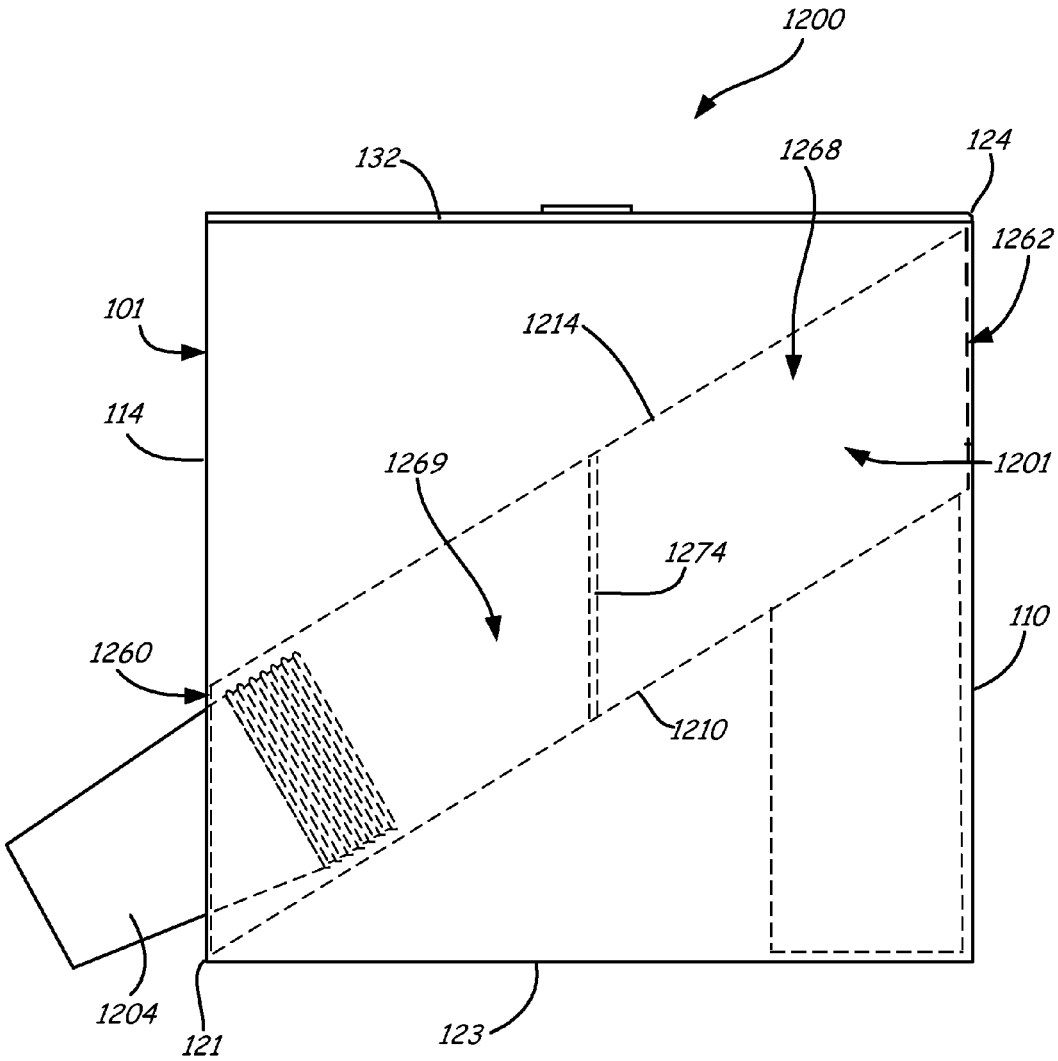
FIG. 18 illustrates a side view of the package illustrated in FIG. 17.

FIG. 18 illustrates a side view of package 1200 of FIG. 17. In FIGS. 17 and 18, an edge of sleeve 1201 formed by a top panel 1214 of sleeve 1201 and second end 1262 substantially abuts first top score edge 124 (see also FIG. 1). First top score edge 124 is the edge that couples top 132 to back panel 110 (FIGS. 1 and 3). As also illustrated in the embodiment of FIGS. 17 and 18, an edge of sleeve 1201 formed by a bottom panel 1210 and first end 1260 substantially abuts bottom score edge 121 (see also FIG. 1). Bottom score edge 121 is the edge that couples bottom 123 with front panel 114.

Sleeve 1201 houses dispensable items, such as a plurality of cups 1204. The plurality of cups 1204 are exposed to the exterior of enclosure 101 through dispensable item opening 152. As illustrated, dispensable item opening 152 has a smaller circumferential opening than that of the opening in first end 1260 of sleeve 1201. In addition, dispensable item opening 152 has a circumferential opening that is less than the circumference of the lip of a cup. Having a smaller sized dispensable item opening 152 than the opening in first end 1260 and the circumference of a cup allows the plurality of cups to feed out of the sleeve and dispensable item opening 152 one at a time from the inclined position.

Package 1200 also includes a flexible fluid container or fluid-containing bladder 1205 located in a fluid portion 1206 of package 1200. Coupled to the fluid container 1205 is a spigot 1208. Spigot 1208 allows access to the fluid contained in container 1205. Spigot 1208 is exposed to the exterior of enclosure 1201 through a spigot opening (hidden from view in FIG. 17). Both spigot flap 146 and a bottom opening edge (also hidden from view in FIG. 17) support spigot 1208 when it is exposed to the exterior of enclosure 1201. Therefore, a user can pull a cup from dispensable item opening 152 and fill the cup with the fluid in container 1205 through spigot 1208.

Package 1200 also includes a trash containing portion 1268. Trash containing portion 1268 is included in sleeve 1201. Trash containing portion 1268 is separated from a clean cup portion 1269 by a separator 1274. As illustrated, enclosure 101 of package 1200 includes a trash opening 1270. In FIG. 17, trash opening 1270 is positioned through back panel 110 at the position of second end 1262 of sleeve 1201. It should be realized, however, that trash opening 1270 can be positioned in other places so that it aligns with sleeve 1201. After a user has pulled a cup from clean cup portion 1269 of sleeve 1201 through dispensable item opening 152 and has filled the cup with the fluid through spigot 1208, the user can drink the fluid and then discard the cup through trash opening 1270 to be contained in trash containing portion 1268 of sleeve 1201.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A package for containing a fluid comprising:

a receptacle comprising:

a top and bottom;

a front panel and a back panel opposing the front panel;

a pair of side panels for coupling the front panel to the back panel and the top to the bottom;

the front panel including a first detachable piece for forming a first opening in the front panel to allow a spigot to protrude from a flexible fluid container housed in the receptacle and a second detachable piece for forming a second opening in the front panel for accessing dispensable items;

a sleeve housed in the receptacle for containing the dispensable items, the sleeve having a first end proximate one of the front panel and the back panel and a second end proximate the other of the front panel and the back panel, the sleeve being inclined from the first end of the sleeve to the second end of the sleeve relative to the bottom of the receptacle and including a sheet material comprising:

a first score;

a second score spaced apart from and substantially parallel with the first score such that the second score and the first score define a bottom panel;

a third score spaced apart from and substantially parallel with the second score such that the third score and the second score define a first side panel;

a fourth score spaced apart from and substantially parallel with the third score such that the fourth score and the third score define a top panel;

a side panel free edge spaced apart from and substantially parallel with the fourth score such that the side panel free edge and the fourth score define a second side panel; and a support panel coupled to the bottom panel by a side score located at the second end of the sleeve and is substantially perpendicular to the first score and the second score, the support panel formable into a position to allow the second end of the sleeve to be inclined from the first end of the sleeve relative to the bottom of the receptacle.

2. The package of claim 1, wherein the bottom panel of the sleeve comprises a pair of slots and the support panel of the sleeve comprises a pair of tabs, the pair of tabs configured to mate with the pair of slots in the bottom panel to form a support.

3. The package of claim 1, wherein the dispensable items comprise a plurality of cups.

4. The package of claim 3, wherein the second opening comprises a circumference that is less than a circumference of a lip of each of the plurality of cups.

5. The package of claim 1, wherein the receptacle comprises:

a first bottom edge that couples the bottom with the front panel;

a first top edge that couples the top with the back panel; and wherein the first end of the sleeve is in contact with the first bottom edge of the receptacle and the second end of the sleeve is in contact with the first top edge of the receptacle.

6. The package of claim 1, wherein the receptacle comprises:

a first bottom edge that couples the bottom with the front panel;

a second bottom edge that couples the bottom with the back panel;

a first top edge that couples the top with the back panel; and wherein the first end of the sleeve is in contact with the first bottom edge of the receptacle and the second end of the sleeve is in contact with the back panel of the receptacle between the first top edge and the second bottom edge.

7. The package of claim 1, wherein the receptacle comprises a third opening for disposing waste in the receptacle.

8. The package of claim 1, wherein the receptacle comprises a third opening for inserting an ice pack to rest on top of the flexible fluid container.

9. The package of claim 1, wherein the sleeve comprises a first portion separated from a second portion of the sleeve by a separator, wherein the first portion of the sleeve houses the dispensable items and the second portion of the sleeve is configured to contain waste and wherein the dispensable items are dispensed through the second opening in the receptacle and waste is inserted into the second portion of the sleeve through a third opening in the receptacle.

10. A fluid-containing system comprising:

a fluid;

a sleeve for containing dispensable items and including a first open end and a second end;

an enclosure including a top and a bottom, a front and an opposing back and a pair of sides coupling the front, the back, the top and the bottom, wherein the enclosure houses the fluid and the sleeve, the sleeve configured to feed the dispensable items through an opening in the enclosure;

wherein the second end of the sleeve is inclined from the first open end of the sleeve relative to the bottom of the enclosure; and wherein the enclosure comprises a sheet material formable into the enclosure and including:

a first score;

a second score spaced apart from and substantially parallel with the first score such that the second score and the first score defines a back panel of the back;

a third score spaced apart from and substantially parallel with the second score such that the third score and the second score define a first side panel of the pair of sides;

a fourth score spaced apart from and substantially parallel with the third score such that the fourth score and the third score define a front panel of the front;

a side panel free edge spaced apart from and substantially parallel with the fourth score such that the side panel free edge and the fourth score define a second side panel of the pair of sides; and at least one top panel coupled to at least one of the back panel, front panel, first side panel and second side panel, the at least one top panel including a handle.

11. The fluid-containing system of claim 10, wherein the dispensable items comprise a plurality of cups.

12. The fluid-containing system of claim 10, wherein the first open end of the sleeve is in contact with an interior of the front panel of the enclosure and the second end of the sleeve is positioned in contact with an interior of the back panel of the enclosure.

13. A package for containing a fluid comprising:

a receptacle comprising:

a top and bottom;

a front panel and a back panel opposing the front panel;

a pair of side panels for coupling the front panel to the back panel and the top to the bottom;

the front panel including a first detachable piece for forming a first opening in the front panel to allow a spigot to protrude from a flexible fluid container housed in the receptacle and a second detachable piece for forming a second opening in the front panel for accessing dispensable items;

a sleeve housed in the receptacle for containing the dispensable items, the sleeve having a first end proximate one of the front panel and the back panel and a second end proximate the other of the front panel and the back panel, the sleeve being inclined from the first end of the sleeve to the second end of the sleeve relative to the bottom of the receptacle; and wherein the sleeve comprises a first portion separated from a second portion of the sleeve by a separator, wherein the first portion of the sleeve houses the dispensable items and the second portion of the sleeve is configured to contain waste and wherein the dispensable items are dispensed through the second opening in the receptacle and waste is inserted into the second portion of the sleeve through a third opening in the receptacle.

14. The package of claim 13, further comprising a support coupled to the second end of the sleeve such that the second end of the sleeve is inclined from the first end relative to the bottom of the receptacle.

15. The package of claim 13, wherein the sleeve comprises a sheet material formable into the sleeve and including:

a first score;

a second score spaced apart from and substantially parallel with the first score such that the second score and the first score define a bottom panel;

a third score spaced apart from and substantially parallel with the second score such that the third score and the second score define a first side panel;

a fourth score spaced apart from and substantially parallel with the third score such that the fourth score and the third score define a top panel;

a side panel free edge spaced apart from and substantially parallel with the fourth score such that the side panel free edge and the fourth score define a second side panel; and a support panel coupled to the bottom panel by a side score located at the second end of the sleeve and is substantially perpendicular to the first score and the second score, the support panel formable into a position to allow the second end of the sleeve to be inclined from the first end of the sleeve relative to the bottom of the receptacle.

16. The package of claim 15, wherein the bottom panel of the sleeve comprises a pair of slots and the support panel of the sleeve comprises a pair of tabs, the pair of tabs configured to mate with the pair of slots in the bottom panel to form a support.

17. The package of claim 13, wherein the dispensable items comprise a plurality of cups.

18. The package of claim 17, wherein the second opening comprises a circumference that is less than a circumference of a lip of each of the plurality of cups.

19. The package of claim 13, wherein the receptacle comprises:

a first bottom edge that couples the bottom with the front panel;

a first top edge that couples the top with the back panel; and wherein the first end of the sleeve is in contact with the first bottom edge of the receptacle and the second end of the sleeve is in contact with the first top edge of the receptacle.

20. The package of claim 13, wherein the receptacle comprises:

a first bottom edge that couples the bottom with the front panel;

a second bottom edge that couples the bottom with the back panel;

a first top edge that couples the top with the back panel; and wherein the first end of the sleeve is in contact with the first bottom edge of the receptacle and the second end of the sleeve is in contact with the back panel of the receptacle between the first top edge and the second bottom edge.

21. The package of claim 13, wherein the receptacle comprises a third opening for disposing waste in the receptacle.

22. The package of claim 13, wherein the receptacle comprises a third opening for inserting an ice pack to rest on top of the flexible fluid container.

* * * * *